US011408661B2

(12) United States Patent
Junge et al.

(10) Patent No.: US 11,408,661 B2
(45) Date of Patent: Aug. 9, 2022

(54) SINGLE CORD ICE PRESS ASSEMBLY

(71) Applicant: Haier US Appliance Solutions, Inc., Wilmington, DE (US)

(72) Inventors: Brent Alden Junge, Evansville, IN (US); Justin Tyler Brown, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 43 days.

(21) Appl. No.: 16/445,512

(22) Filed: Jun. 19, 2019

(65) Prior Publication Data

US 2020/0400359 A1 Dec. 24, 2020

(51) Int. Cl.

| | |
|---|---|
| ***F25C 5/14*** | (2006.01) |
| ***F25C 5/08*** | (2006.01) |
| ***F25C 1/22*** | (2018.01) |
| ***F28D 15/02*** | (2006.01) |
| ***H05B 3/40*** | (2006.01) |

(52) U.S. Cl.

CPC ..... *F25C 5/14* (2013.01); *F25C 1/22* (2013.01); *F25C 5/08* (2013.01); *F28D 15/0275* (2013.01); *H05B 3/40* (2013.01); *F25C 2400/06* (2013.01); *F25C 2500/02* (2013.01); *F25D 2400/40* (2013.01); *F28D 15/02* (2013.01); *F28D 2015/0216* (2013.01)

(58) Field of Classification Search

CPC ..... F25C 5/14; F25C 1/22; F25C 5/08; F25C 2400/06; F25C 2500/02; F25D 2400/40; H05B 3/40

See application file for complete search history.

(56) References Cited

U.S. PATENT DOCUMENTS

| | | | | | |
|---|---|---|---|---|---|
| 1,888,938 | A | * | 11/1932 | Shellman | B23D 45/102 83/878 |
| 2,259,066 | A | * | 10/1941 | Gaston | F25C 1/04 62/135 |
| 3,362,045 | A | * | 1/1968 | Gray | B29C 51/267 425/388 |
| 3,365,764 | A | * | 1/1968 | Wall | B29C 43/00 425/392 |
| 3,721,103 | A | * | 3/1973 | Brandt | F25C 1/04 62/73 |
| 4,028,042 | A | * | 6/1977 | Goodfellow | B29C 43/04 425/515 |
| 4,244,470 | A | * | 1/1981 | Burnham | A23G 9/503 206/525 |

(Continued)

FOREIGN PATENT DOCUMENTS

| | | | |
|---|---|---|---|
| CN | 205718125 | U | 11/2016 |
| JP | H01310277 | A | 12/1989 |
| JP | 6076867 | B2 | 2/2017 |

*Primary Examiner* — Ljiljana V. Cinc

(74) *Attorney, Agent, or Firm* — Doritv & Manning, P.A.

(57) ABSTRACT

An electric ice press includes a mold body having a first mold segment and a second mold segment movable relative to each other. A heated guide rail extends between the first mold segment and the second mold segment to transfer heat from the first mold segment to the second mold segment. The heated guide rail may be a heat pipe for transferring heat generated by a base heater in the first mold segment or an electrical resistance heating rod for generating heat, either of which requires only a single power cord electrically coupled to only the first mold segment.

14 Claims, 6 Drawing Sheets

(56) References Cited

U.S. PATENT DOCUMENTS 4,587,810 A * 5/1986 Fletcher ..... F25B 21/02 249/130
4,746,523 A * 5/1988 Binley ..... A23G 9/083 264/28
4,971,737 A * 11/1990 Infanti ..... A23L 3/364 249/55
5,372,492 A * 12/1994 Yamauchi ..... F25C 5/14 249/79
5,738,895 A * 4/1998 Fuchs ..... A23G 9/083 425/126.2
6,156,366 A * 12/2000 Waldstrom ..... A23G 9/14 426/515
6,561,787 B2 * 5/2003 Sun ..... C08L 5/14 425/412
6,857,277 B2 2/2005 Somura
6,935,124 B2 8/2005 Takahashi et al.
7,085,482 B2 * 8/2006 Renoud-Grappin ..... A01K 63/065 219/494
7,252,280 B2 * 8/2007 Hollands ..... B29C 33/44 249/105
7,882,706 B2 * 2/2011 Thali ..... F25D 3/08 62/72
7,900,470 B2 * 3/2011 Rafalovich ..... F25C 5/043 62/351
8,882,489 B1 * 11/2014 Coomer ..... F25C 5/14 425/407
9,074,802 B2 * 7/2015 Culley ..... F25C 1/25
9,080,800 B2 * 7/2015 Culley ..... F25C 1/22
9,151,527 B2 * 10/2015 Boarman ..... F25C 1/22
9,310,116 B2 * 4/2016 Culley ..... F25C 1/25
9,459,034 B2 10/2016 Boarman et al.
9,470,448 B2 * 10/2016 Culley ..... F25C 5/08
9,574,811 B2 2/2017 Papalia
9,651,290 B2 * 5/2017 Boarman ..... F25C 1/18
9,677,808 B2 * 6/2017 Culley ..... F25C 1/25
9,759,472 B2 * 9/2017 Boarman ..... F25C 1/10
9,890,986 B2 * 2/2018 Boarman ..... F25C 5/08
10,047,996 B2 * 8/2018 Boarman ..... F25C 1/12
10,605,512 B2 * 3/2020 Culley ..... F25C 1/22
10,690,388 B2 * 6/2020 Becker ..... F25C 5/185
10,729,154 B2 * 8/2020 Schroeder ..... A23G 9/083
10,746,453 B2 * 8/2020 Tarr ..... F25C 5/08
D908,147 S * 1/2021 Steere ..... D15/90
D920,396 S * 5/2021 Martocchio ..... D15/90
2004/0206250 A1 * 10/2004 Kondou ..... F25C 5/14 99/426
2006/0083498 A1 * 4/2006 Renoud-Grappin ..... A01K 63/065 392/478
2008/0072610 A1 * 3/2008 Venkatakrishnan ..... F25C 5/08 62/135
2009/0255293 A1 * 10/2009 Thali ..... F25C 1/22 62/457.5
2010/0055223 A1 * 3/2010 Kondou ..... F25C 5/14 425/234
2014/0047859 A1 2/2014 Schwulst
2014/0165619 A1 * 6/2014 Culley ..... F25C 1/18 62/71
2014/0165620 A1 * 6/2014 Culley ..... F25C 1/18 62/71
2019/0120534 A1 * 4/2019 Chan ..... F25C 1/10
2019/0195545 A1 * 6/2019 Alshourbagy ..... F25C 5/22
2019/0264970 A1 * 8/2019 Tarr ..... F25C 5/14
2021/0080166 A1 * 3/2021 Connor ..... B29C 51/42

* cited by examiner

SINGLE CORD ICE PRESS ASSEMBLY

FIELD OF THE INVENTION

The present subject matter relates generally to appliances for shaping ice and more particularly to an electric ice press for shaping ice to a predetermined desired profile.

BACKGROUND OF THE INVENTION

In domestic and commercial applications, ice is often formed as solid cubes, such as crescent cubes or generally rectangular blocks. The shape of such cubes is often dictated by the container holding water during a freezing process. For instance, an ice maker can receive liquid water, and such liquid water can freeze within the ice maker to form ice cubes. In particular, certain ice makers include a freezing mold that defines a plurality of cavities. The plurality of cavities can be filled with liquid water, and such liquid water can freeze within the plurality of cavities to form solid ice cubes. Typical solid cubes or blocks may be relatively small in order to accommodate a large number of uses, such as temporary cold storage and rapid cooling of liquids in a wide range of sizes.

Although the typical solid cubes or blocks may be useful in a variety of circumstances, there are certain conditions in which distinct or unique ice shapes may be desirable. As an example, it has been found that relatively large ice cubes or spheres (e.g., larger than two inches in diameter) will melt slower than typical ice sizes/shapes. Slow melting of ice may be especially desirable in certain liquors or cocktails. Moreover, such cubes or spheres may provide a unique or upscale impression for the user.

In the past, users desiring larger or uniquely-shaped pieces of ice were forced to utilize cumbersome techniques and devices. As an example, large billets of ice may be shaved or sculpted by hand. However, sculpting ice by hand can be extremely difficult, dangerous, and time-consuming. In recent years, passive ice presses have come to market. Typically, these passive presses include large solid metal pieces that define a profile to which a larger ice billet may be reshaped. Generally, the passive presses rely on the large mass of the press to slowly melt a large ice billet into a desired shape. Such systems reduce some of the dangers and user skill required when reshaping ice by hand. However, the systems require large amounts of solid metal, and the process is still very time-consuming. Moreover, typical ice presses use the heat capacity of the metal molds to supply the needed heat. Therefore, melting multiple pieces of ice in succession may require a user to place the passive press under hot water between each ice piece or wait until the mold is heated.

Alternatively, certain ice presses use an electric heater for heating the ice mold, but such presses use two power cords—one for each of the two molds halves—resulting in a cumbersome appliance requiring multiple electrical outlets. Specifically, the power cord to the upper half is especially cumbersome, whereas the power cord supplying electricity to the lower half can be routed through the base to limit the inconvenience.

Accordingly, further improvements in the field of ice-shaping would be desirable. In particular, it may be desirable to provide an appliance or assembly for rapidly and reliably producing ice pieces that have a relatively-large predetermined shape or profile using a single power cord.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an electric ice press defines an axial direction. The electric ice press includes a mold body including a first mold segment and a second mold segment, the first mold segment and the second mold segment being movable relative to each other along the axial direction and defining a mold cavity. A heated guide rail extends from the first mold segment toward the second mold segment along the axial direction and a sleeve is defined within the second mold segment for receiving the heated guide rail and placing the second mold segment in thermal communication with the heated guide rail.

In another exemplary aspect of the present disclosure, an electric ice press defines an axial direction and includes a first mold segment and a second mold segment movable relative to the first mold segment along the axial direction. An electrical resistance heating rod extends from the first mold segment toward the second mold segment along the axial direction, a sleeve is defined within the second mold segment for receiving the electrical resistance heating rod and placing the second mold segment in thermal communication with the electrical resistance heating rod, and a power cord is electrically coupled to the electrical resistance heating rod through the first mold segment.

According to still another exemplary embodiment, an electric ice press is provided defining an axial direction. The electric ice press includes a first mold segment and a second mold segment movable relative to the first mold segment along the axial direction. A heat pipe extends from the first mold segment toward the second mold segment along the axial direction and a sleeve is defined within the second mold segment for receiving the heat pipe and placing the second mold segment in thermal communication with the heat pipe. A base heater is mounted within the first mold segment and a power cord is electrically coupled to the base heater through the first mold segment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
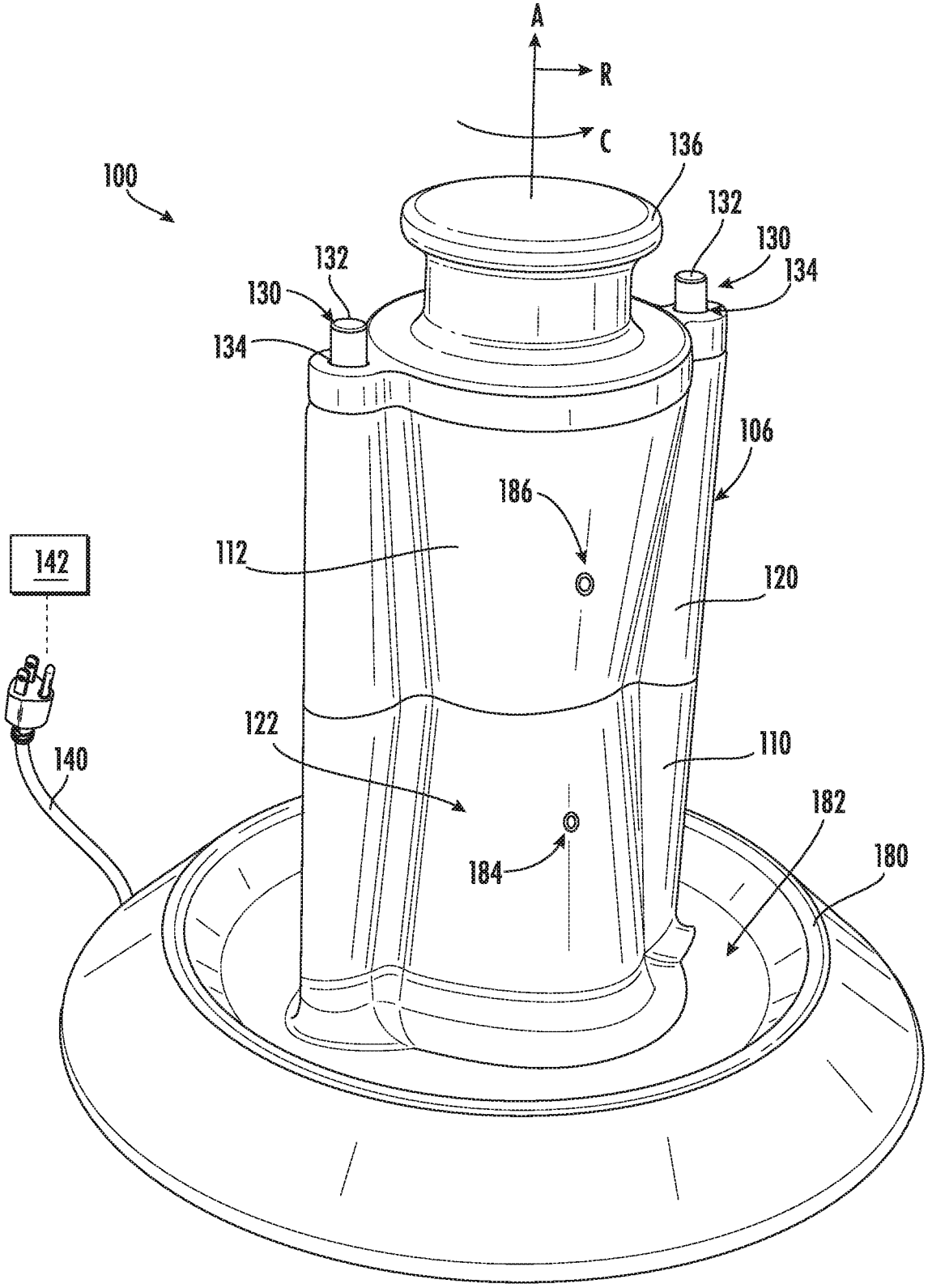
FIG. 1 provides a perspective view of an ice press appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The term "or" is generally intended to be inclusive (i.e., "A or B" is intended to mean "A or B or both"). In addition, terms of approximation, such as "approximately," "substantially," or "about," refer to being within a ten percent margin of error.

Figure 2:
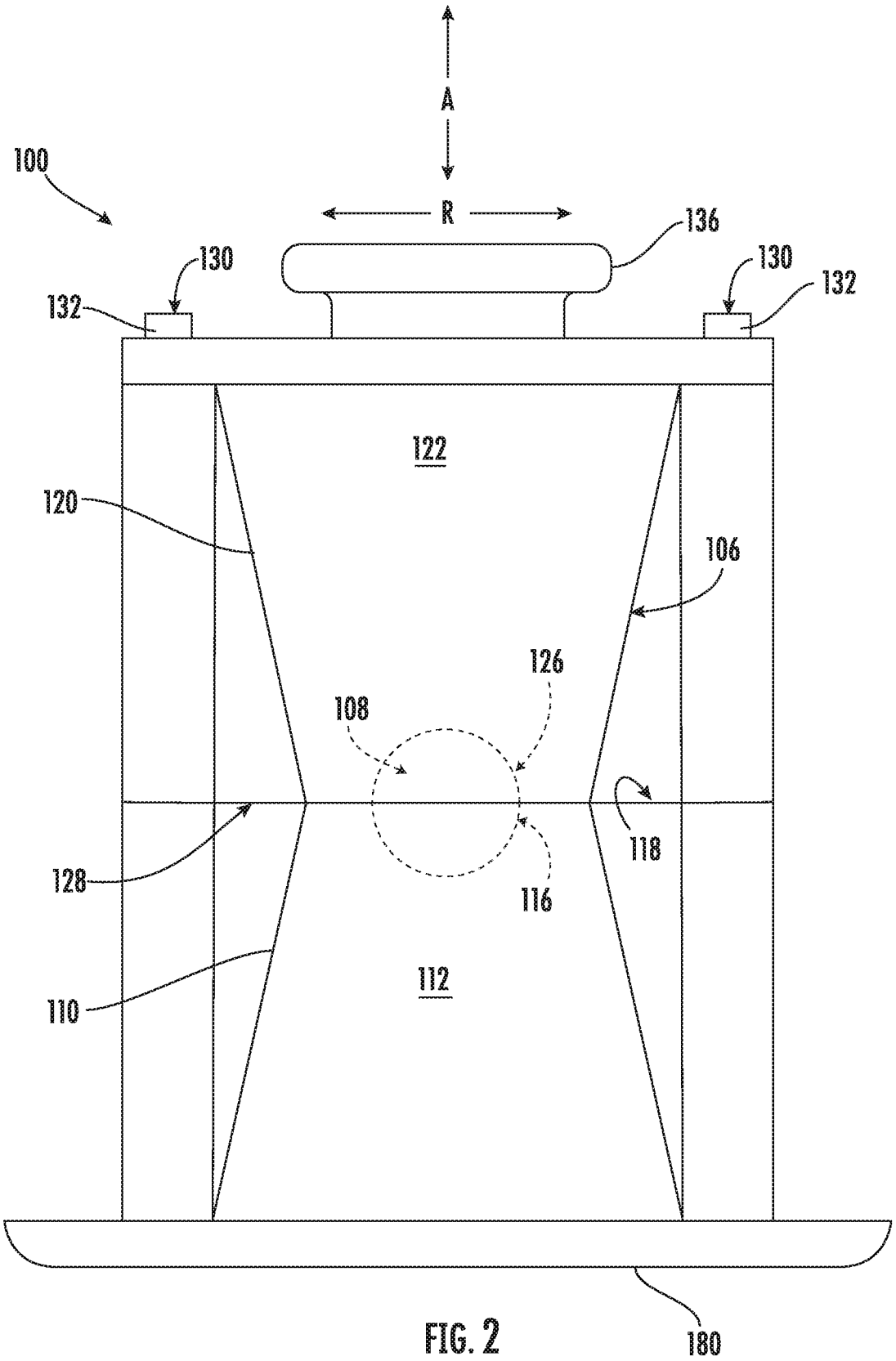
FIG. 2 provides a front view of the exemplary ice press appliance of FIG. 1.
Figure 4:
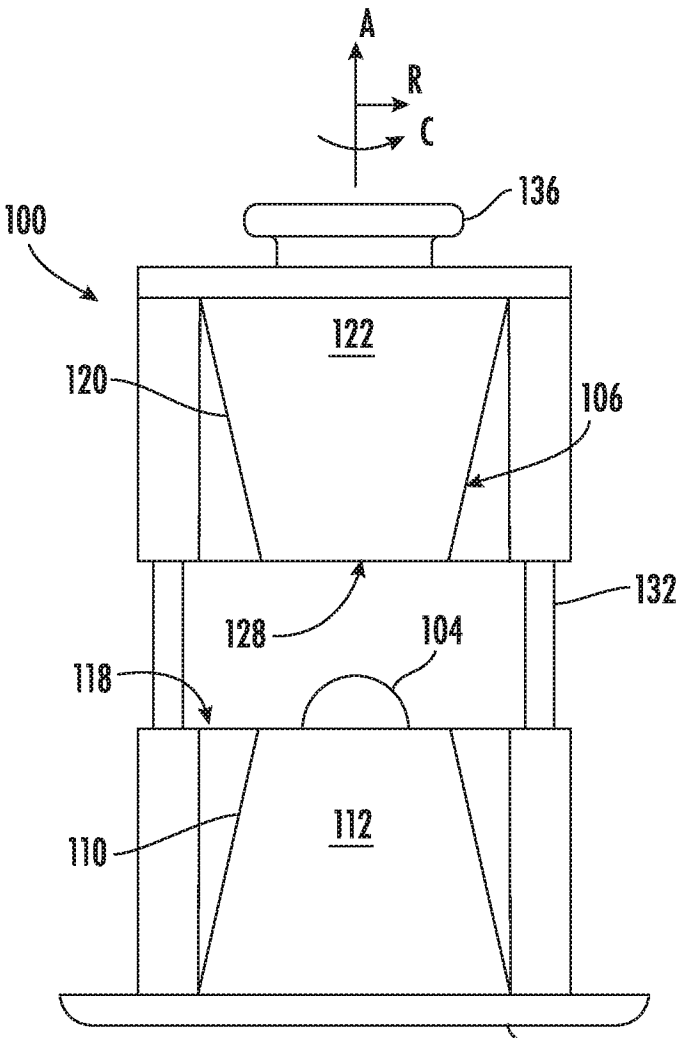
FIG. 4 provides a front view of the exemplary ice press appliance of FIG. 1, wherein the ice press appliance is provided in a receiving position with a sculpted ice nugget.
Figure 3:
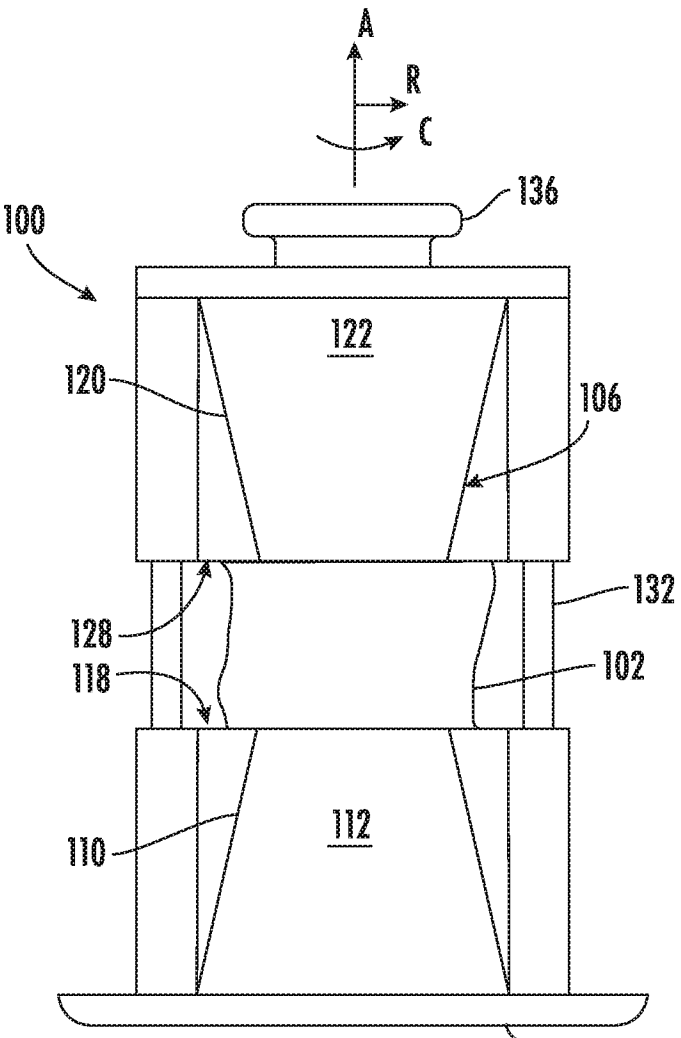
FIG. 3 provides a front view of the exemplary ice press appliance of FIG. 1, wherein the ice press appliance is provided in a receiving position with an initial ice billet.
Figure 5:
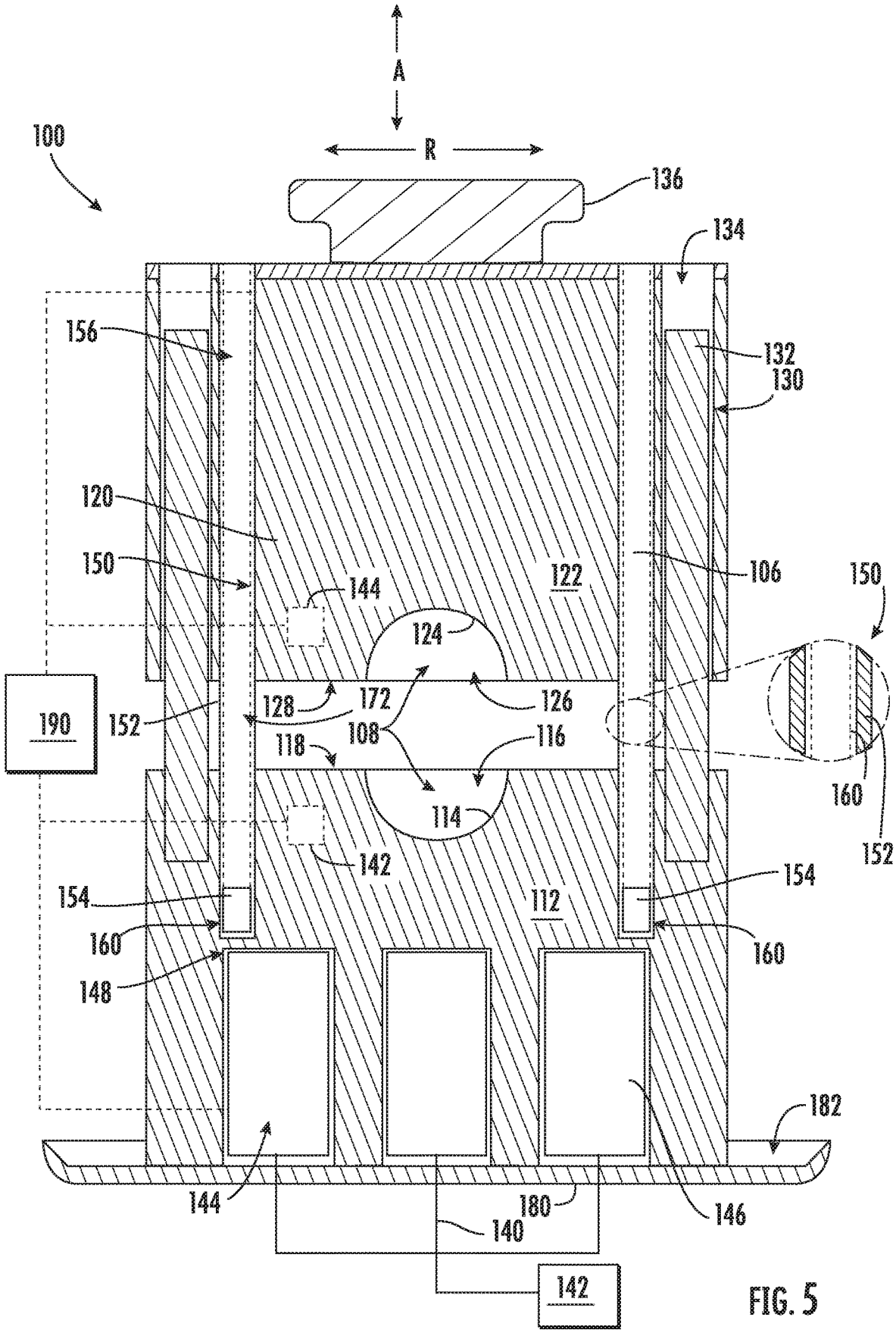
FIG. 5 provides a front cross-sectional view of an ice press appliance according to exemplary embodiments of the present disclosure.
Figure 6:
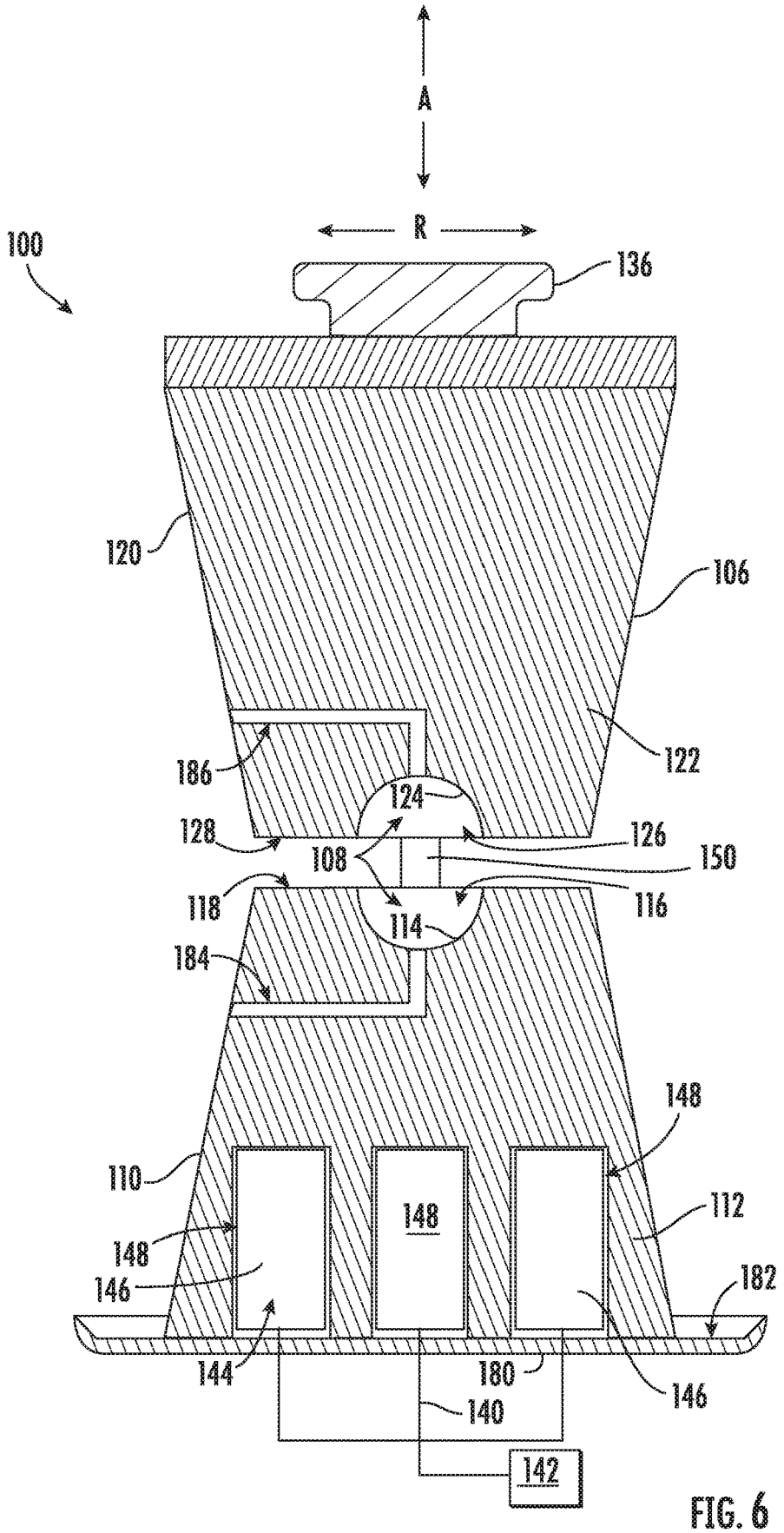
FIG. 6 provides a side cross-sectional view of the exemplary ice press appliance of FIG. 5.
Figure 7:
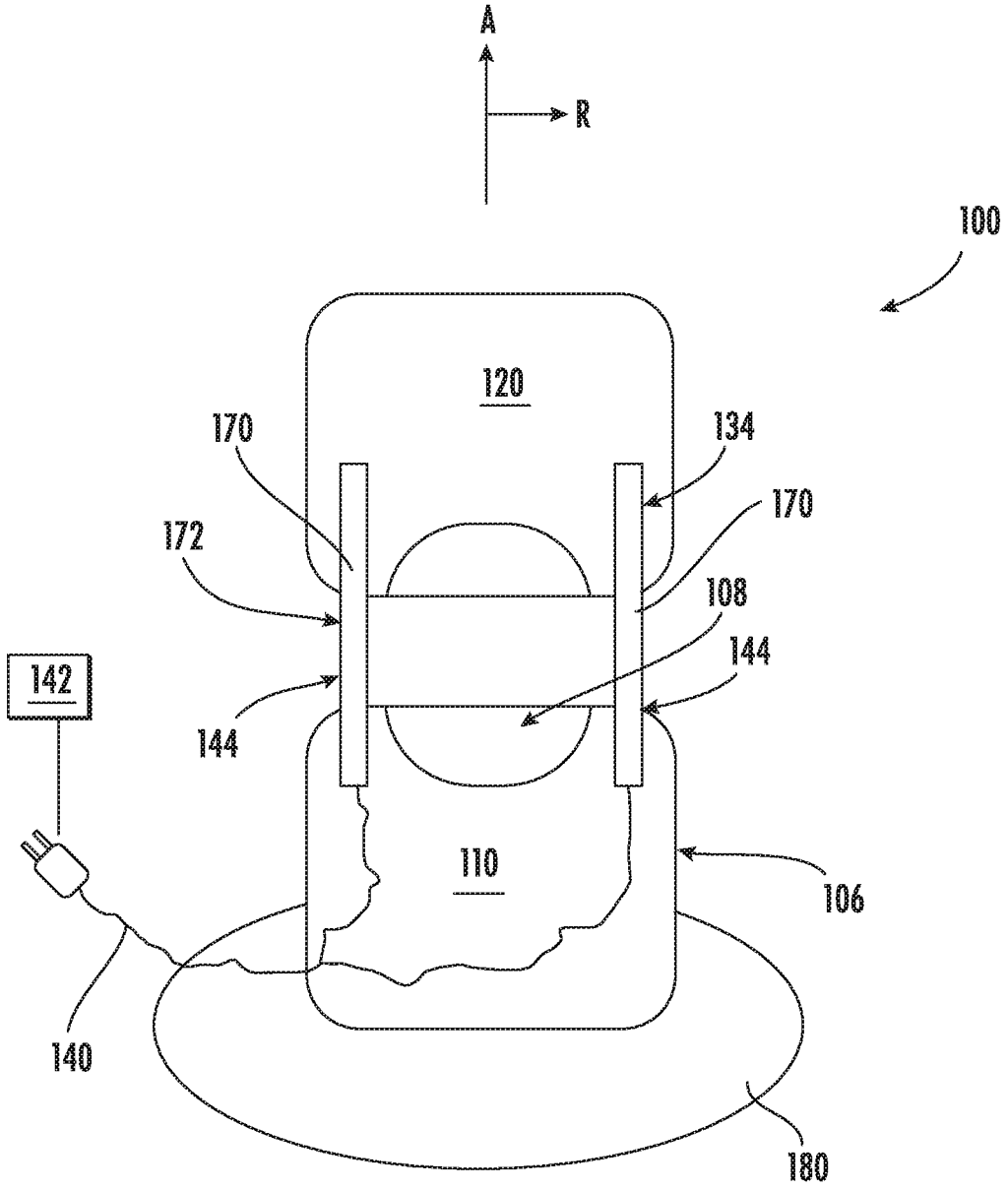
FIG. 7 provides a schematic cross-sectional view of an ice press appliance according to exemplary embodiments of the present disclosure.

Turning now to the figures, FIGS. 1 through 7 provide views of an ice press 100 according to exemplary embodiments of the present disclosure. Generally, ice press 100 may serve to reshape or transform a relatively-large initial ice billet 102 (e.g., an integral or monolithic block of raw unsculpted ice, see FIG. 3) into a relatively-small sculpted ice nugget 104 (see, e.g., FIG. 4) that has a predetermined desirable profile. FIG. 1 provides a perspective view of ice press 100. FIG. 2 provides a front view of ice press 100 in a closed or sculpted position. FIGS. 3 and 4 provide front views of ice press 100 in an open or receiving position. FIG. 5 provides a front cross-sectional view of ice press 100. FIG. 6 provides a side cross-sectional view of ice press 100. FIG. 7 provides a schematic view of ice press 100 according to another exemplary embodiment.

As shown, ice press 100 includes a mold body 106 that defines an axial direction A. A radial direction R may be defined outward from (e.g., perpendicular to) axial direction A. A circumferential direction C may be defined about axial direction A (e.g., perpendicular to axial direction A in a plane defined by radial direction R).

Within mold body 106, a mold cavity 108 is defined. As will be described below, within mold cavity 108 the sculpted ice nugget 104 is shaped and its profile is determined. In some embodiments, mold cavity 108 is defined by two discrete mold segments 110, 120. For instance, a first mold segment 110 and a second mold segment 120 may be selectively mated to each other and, together, define mold cavity 108.

Each mold segment 110, 120 generally includes an outer sidewall 112, 122 and an inner cavity wall 114, 124. In particular, the outer sidewall 112, 122 of each mold segment 110, 120 faces outward (e.g., in the radial direction R) toward the ambient environment. The outer sidewall 112, 122 may generally extend about the axial direction A (e.g., along the circumferential direction C). Moreover, outer sidewalls 112, 122 may extend from an upper portion of the corresponding mold segment 110, 120 to a lower portion of the mold segment 110, 120. As a result, a user may be able to view and touch the outer sidewall 112, 122 of each assembled mold segment 110, 120, regardless of whether ice press 100 is in the receiving position or the sculpted position.

In contrast to the outer sidewall 112, 122, the inner cavity wall 114, 124 of each mold segment 110, 120 faces inward (e.g., within mold body 106) and toward mold cavity 108. For instance, each inner cavity wall 114, 124 may be formed about and extend radially outward from the axial direction A. The inner cavity wall 114 of the first mold segment 110 may generally face upward (e.g., relative to the axial direction A) toward a bottom portion of the second mold segment 120. The inner cavity wall 124 of the second mold segment 120 may generally face downward (e.g., relative to the axial direction A) toward an upper portion of first mold segment 110.

In some embodiments, the inner cavity walls 114, 124 define at least a portion of mold cavity 108. For instance, the inner cavity wall 114 of first mold segment 110 may form a first cavity portion 116 (e.g., along the inner cavity wall 114). Additionally or alternatively, the inner cavity wall 124 of second mold segment 120 may define a second cavity portion 126 (e.g., above the first cavity portion 116 along the corresponding inner cavity wall 124 of second mold segment 120). As shown, each inner cavity wall 114, 124 may be generally open to the ambient environment when ice press 100 is in the receiving position and enclosed or otherwise restricted from user view and access when ice press 100 is in the sculpted position.

A first mating surface 118 may be defined on a top end of first mold segment 110 and a second mating surface 128 may be defined on a bottom end of second mold segment 120 (e.g., such that second mating surface generally faces downward toward first mating surface 118 along the axial direction A). Mating surfaces 118, 128 generally join corresponding outer sidewalls 112, 122 and inner cavity walls 114, 124. In particular, mating surfaces 118, 128 may extend along the radial direction R between the outer sidewall 112, 122 and the inner cavity wall 114, 124. For instance, first mating surface 118 of first mold segment 110 may extend in the radial direction R from the perimeter or outer radial extreme of inner cavity wall 114 to the corresponding outer sidewall 112. Second mating surface 128 of second mold segment 120 may extend in the radial direction R from the perimeter or outer radial extreme of inner cavity wall 124 to the corresponding outer sidewall 122.

Together, the mating surfaces 118, 128 may be formed as complementary surfaces to contact each other (e.g., in the sculpted position). In addition, according to the illustrated exemplary embodiment, mating surface 118, 128 are defined approximately at a midpoint or equator of mold body 106 along the axial direction A, e.g., such that two hemispheres (i.e., mold halves or segments 110, 120) are defined. However, it should be appreciated the shape, position, and relative sizes of mold segments 110, 120 may vary while remaining within the scope of the present subject matter.

It is generally understood that mold body 106 may be formed from any suitable material. For instance, one or more portions (e.g., inner cavity walls 114, 124) may be formed from a conductive metal, such as aluminum, stainless, steel, or copper (including alloys thereof). Optionally, one or more portions of mold body 106 may be integrally formed (e.g., as unitary monolithic members). As an example, inner cavity wall 114 of first mold segment 110 may be integrally formed within one or both of first mating surface 118 and outer sidewall 112. As an additional or alternative example, inner cavity wall 124 of second mold segment 120 may be integrally formed with one or both of mating surface 128 and outer sidewall 122.

Generally, the sculpted ice nugget 104 will be shaped within and conform to mold cavity 108 along the inner cavity walls 114, 124. The resulting sculpted ice nugget 104 is therefore a solid unitary ice piece that is shaped according to the shape or profile of inner cavity walls 114, 124 (e.g., in the sculpted position). Thus, the adjoined inner cavity walls 114, 124 (i.e., in the sculpted position) and cavity portions 116, 126 may define the ultimate shape or profile of sculpted ice nugget 104.

In some embodiments, one or both of cavity portions 116, 126 are hemispherical voids. For instance, first cavity portion 116 may be a lower hemispherical void and second cavity portion 126 may be an upper hemispherical portion. Together, the cavity portions 116, 126 may thus define mold cavity 108 and thereby sculpted ice nugget 104 as a sphere. Optionally, each hemispherical void may have a diameter that is greater than two inches. According to other exemplary embodiments, mold cavity 108 may be a sphere of approximately 3 inches in diameter, or larger. Nonetheless, it is understood that any other suitable shape (e.g., a geometric cube, polyhedron, etc.) or profile may be provided. Moreover, it is further understood that additional or alternative embodiments may provide a predefined embossing or engraving along one or more of the inner cavity walls 114, 124 to direct the shape or profile of sculpted ice nugget 104.

As illustrated, the mold segments 110, 120 can be selectively separated or moved relative to each other (e.g., as desired by user). For instance, second mold segment 120 may be movably positioned above first mold segment 110 along the axial direction A. When assembled, second mold segment 120 may thus move (e.g., slide or pivot) up and down along the axial direction A. In particular, second mold segment 120 may move and alternate between the sculpted position (e.g., FIGS. 1 through 2) and the receiving position (e.g., FIGS. 3 through 7).

In the sculpted position, mold cavity 108 is generally enclosed, such that access to mold cavity 108 is restricted. Moreover, second mold segment 120 may be supported or rest on first mold segment 110. In some such embodiments, a lower portion of second mold segment 120 contacts (e.g., directly or indirectly contacts) an upper portion of first mold segment 110. For instance, first mating surface 118 may directly contact second mating surface 128, e.g., such that mating surfaces 118, 128 are seated against each other. In the sculpted position, both cavity portions 116, 126 may be aligned (e.g., in the axial direction A and the radial direction R) in mutual fluid communication. The unified mold cavity 108 may furthermore be enclosed by the cavity portions 116, 126 (e.g., at the inner cavity walls 114, 124 defining first cavity portion 116 and second cavity portion 126, respectively).

In contrast to the sculpted position, mold cavity 108 is generally open in the receiving position. For instance, discrete portions 116, 126 of mold cavity 108 may be separated from each other such that a void or gap is defined (e.g., in the axial direction A) between first mold segment 110 and second mold segment 120. Access to mold cavity 108 may thus be permitted. Moreover, as illustrated in FIG. 3, the initial ice billet 102 (being larger in volume than the volume of the enclosed mold cavity 108) may be placed on mold body 106. Specifically, the initial ice billet 102 may be placed on an upper portion of first mold segment 110 or within the void or gap defined between first mold segment 110 and second mold segment 120. If a reshaping operation has already been performed (e.g., the initial ice billet 102 has been reshaped as the sculpted ice nugget 104), the sculpted ice nugget 104 may be accessed at the receiving position, as illustrated in FIG. 4.

In certain embodiments, the movement of second mold segment 120 relative to first mold segment 110 is guided by one or more attachment features. For instance, as shown in the exemplary embodiments of FIGS. 3 through 5, one or more complementary structural guide rail-sleeve pairs 130 may be defined between first mold segment 110 and second mold segment 120 on mold body 106. Such structural guide rail-sleeve pairs 130 each include a mated structural guide rail 132 and structural sleeve 134 within which the structural guide rail 132 may slide. Each structural guide rail-sleeve pair 130 may extend parallel to the axial direction A to guide or facilitate the sliding of second mold segment 120 relative to first mold segment 110 along the axial direction A. Moreover, structural guide rail-sleeve pairs 130 may align the mold segments 110, 120 (e.g., as second mold segment 120 moves to the sculpted position). Optionally, the structural guide rail-sleeve pairs 130 may be freely separable (e.g., upward along the axial direction A), thereby permitting the complete removal of second mold segment 120 from first mold segment 110. Notably, a wider variety of sizes of ice billet 102 may be accommodated between the mold segments 110, 120.

As shown, a handle 136 may be fixed to second mold segment 120 (e.g., at a top portion thereof), allowing a user to easily grab or lift second mold segment 120. In some such embodiments, the lifting force necessary to move second mold segment 120 upward (e.g., from the sculpted position to the receiving position) can be selectively provided, at least in part, by a user. A closing force necessary to move second mold segment 120 downward (e.g., from the receiving position to the sculpted position) may be provided, at least in part, by gravity.

Although the figures illustrate two manual sliding structural guide rail-sleeve pairs 130. It is understood that any other suitable alternative arrangement may be provided for connecting and guiding movement between first mold segment 110 and second mold segment 120. As an example, three or more sliding structural guide rail-sleeve pairs 130 may be provided. As an additional or alternative example, one or more motors (e.g., linear actuators) may be provided to motivate or assist relative movement of the mold segments 110, 120. As yet another additional or alternative example, a multi-axis pivot assembly (e.g., having at least two parallel rotation axes) may connect second mold segment 120 to first mold segment 110 and permit rotational as well as axial movement.

As explained above, ice press 100 may include structural guide rail-sleeve pairs 130 for facilitating the opening and closing of mold body 106 while maintaining proper alignment of first mold segment 110 and second mold segment 120. However, aspects of the present subject matter are generally directed to features or elements which may be used in addition to, or may entirely replace, structural guide rail-sleeve pairs 130, while also transferring thermal energy into second mold segment 120. In this manner, as will be described generally herein, ice press 100 may be provided with a single power cord 140 which is electrically coupled with a single power supply 142 for heating mold body 106 during the formation or sculpting of sculpted ice nugget 104.

Specifically, turning now generally to FIGS. 5 through 7, ice press 100 includes one or more electric heating elements or electric heaters 144 that is/are disposed within mold body 106 to generate heat during use (e.g., reshaping operations). Specifically, as shown, the electric heater(s) 144 is/are disposed within mold body 106 in conductive thermal engagement with mold cavity 108. Heat generated at the electric heater(s) 144 may thus be conducted through mold body 106 and to mold cavity 108 (e.g., through inner cavity walls 114, 124). FIGS. 5 and 6 respectively provide front and side cross-sectional views of one exemplary embodiment, including one configuration of heaters 144. FIG. 7 provides a front cross-sectional view of another exemplary embodiment, including the use of heating rods. It is noted that although these exemplary embodiments are explicitly illustrated, one of ordinary skill in the art would understand that additional or alternative embodiments or configurations may be provided to include one or more features of these examples (e.g., to include one or more additional heaters or configurations from those shown in FIGS. 5 through 7).

Generally, the electric heater(s) 144 are provided as any suitable electrically-driven heat generator. For instance, electric heating element 144 may include one or more resistive heating elements. For example, positive thermal coefficient of resistance heaters that increase in resistance upon heating may be used, such as metal, ceramic, or polymeric PTC elements (e.g., such as electrical resistance heating rods or calrod heaters). Additionally or alternatively, it is understood that other suitable heating elements, such as a thermoelectric heating element, may be included with the electric heater(s) 144.

Referring now again to FIGS. 5 and 6, electric heating element 144 is illustrated as a base heater 146 positioned within a heater chamber 148 within first mold segment 110. As explained briefly above, base heater 146 may be any suitable heating element, such as a resistive heating element. In this manner, base heater 146 is electrically coupled with power supply 142 through power cord 140. As power is supplied through base heater 146, heat is generated to warm first mold segment 110. Notably, however, heating only first mold segment 110 may result in a temperature imbalance or gradient through mold body 106. Specifically, if second mold segment 120 is cool, sculpting issues may arise when forming sculpted ice nugget 104. Therefore, aspects of the present subject matter are directed to means for transferring thermal energy from first mold segment 110 to second mold segment 120 without requiring a dedicated heater within second mold segment 120.

Specifically, as illustrated in FIG. 5, ice press 100 includes, in addition to structural guide rail-sleeve pairs 130, one or more heat pipes 150 for transferring thermal energy from the first mold segment 110 to second mold segment 120, such that mold body 106 maintains a substantially constant temperature. According to the illustrated embodiment, heat pipes 150 extend along the axial direction A parallel to structural guide rails 132. Thus, heat pipes 150 may extend along the axial direction A from first mold segment 110 through a complementary sleeve 134 defined in second mold segment 120. However, it should be appreciated that according to alternative embodiments, structural guide rail-sleeve pairs 130 may be removed altogether, and heat pipes 150 may be used to perform the same structural support/sliding function. In this regard, for example, heat pipes 150 may serve to both align and permit axial movement of second mold segment 120 relative to first mold segment 110.

As used herein, the term "heat pipe" and the like are intended to refer to any suitable device or heat exchanger for transferring thermal energy through the evaporation and condensation of a working fluid within a cavity. In this regard, heat pipes 150 may provide thermal communication between first mold segment 110 and second mold segment 120, e.g., to permit the flow of thermal energy from first mold segment 110 to second mold segment 120 such that they maintain substantially the same temperatures for even melting or sculpting of initial ice billet 102.

As shown, heat pipes 150 each include a sealed casing 152 containing a working fluid 154 within casing 152. The casing 152 is preferably constructed of a material with a high thermal conductivity, such as a metal, such as copper or aluminum. In some embodiments, the working fluid 154 may be water. In other embodiments, suitable working fluids for the heat pipes 150 include acetone, methanol, ethanol, or toluene. Any suitable fluid may be used for working fluid 154, e.g., any fluid that is compatible with the material of the casing 152 and is suitable for the desired operating temperature range.

According to the illustrated embodiment, heat pipes 150 generally extend between a condenser section 156 at one end of heat pipes 150 and an evaporator section 158 at an opposite end of heat pipes 150. The working fluid 154 contained within the casing 152 of the heat pipes 150 absorbs thermal energy at the evaporator section 158, whereupon the working fluid 154 travels in a gaseous state from the evaporator section 158 to the condenser section 156. At the condenser section 156, the gaseous working fluid 154 condenses to a liquid state and thereby releases thermal energy.

According to an exemplary embodiment, heat pipes 150 may include a plurality of surface aberrations, protrusions, or fins (not shown) for increasing the rate of thermal transfer. In this regard, such fins may be provided on an external surface of the casing 152 at either or both of the condenser section 156 and the evaporator section 158. These fins may provide an increased contact area between the heat pipes 150 and mold body 106. According to alternative embodiments, no fins are used and casing 152 is simply a smooth heat exchange pipe.

In general, evaporator section 158 may be physically connected to first mold segment 110, may be positioned adjacent to first mold segment 110, or may otherwise be in thermal communication with first mold segment 110. Thus, as first mold segment 110 heats up during operation, thermal energy from first mold segment 110 may transfer to working fluid 154, which evaporates and travels through heat pipes 150 toward condenser section 156. Thermal energy from the evaporated working fluid 154 is then transferred through casing 152 to second mold segment 120. As the working fluid 154 cools, it will condense and flow in liquid form back to the evaporator section 158, e.g., by gravity and/or capillary flow.

According to exemplary embodiments, heat pipes 150 may further include an internal wick structure 160 to transport liquid working fluid 154 from the condenser section 156 to the evaporator section 158 by capillary flow. In some embodiments, the heat pipes 150 may be constructed and arranged such that the liquid working fluid 154 returns to the evaporator section 158 by gravity flow, including solely by gravity flow. For example, heat pipes 150 may be arranged with the condenser section 156 positioned above the evaporator section 158 along the vertical direction such that condensed working fluid 154 in a liquid state may flow from the condenser section 156 to the evaporator section 158 by gravity. In such embodiments, where the liquid working fluid 154 may return to the evaporator section 158 by gravity, wick structure 160 may be omitted whereby the liquid working fluid 154 may return to the evaporator section 158 solely by gravity flow.

Notably, certain positions, orientations, and configurations of heat pipes 150 may provide increased rates of thermal transfer within mold body 106. One exemplary configuration is illustrated in the figures and described herein for the purpose of explaining aspects of the present subject matter. However, it should be appreciated that this configuration is only exemplary and is not intended to limit the subject matter of the present application in any manner.

Referring now to FIG. 7, an alternative configuration of ice press 100 will be described according to an exemplary embodiment of the present subject matter. According to this embodiment, electric heating element 144 is embodied as in electrical resistance heating rod 170. As explained above, heating elements 144 (such as electrical resistance heating rods 170) may be positive temperature coefficient resistance heaters (PTCR) or any other suitable heating element, such that the resistance of such heaters increases as its temperature increases. Notably, in this manner, even if second mold segment 120 is removed from ice press, a temperature of electrical resistance heating rod 170 will not exceed a predetermined threshold. It should be appreciated that according to alternative embodiments, electrical resistance heating rods 170 may be any other suitable type, style, or configuration of heating element.

According to the illustrated embodiment, electrical resistance heating rods 170 replace structural guide rail-sleeve pairs 130. Thus, electrical resistance heating rods 170 extend along the axial direction A from first mold segment 110 through a complementary sleeve 134 defined in second mold segment 120. In this manner, electrical resistance heating rods 170 facilitate the sliding and alignment of second mold segment 120 relative to first mold segment 110. It should be appreciated that according to alternative embodiments, electrical resistance heating rods 170 may be used in conjunction with structural guide rail-sleeve pairs 130 or with heat pipes 150. Because electrical resistance heating rods 170 and heat pipes 150 may be substituted for structural guide rails 132 according to various embodiments the present subject matter, these features may be referred to herein generally as heated guide rails 172. Other configurations of electric heating elements and guide rails are possible and within the scope of the present subject matter.

Referring still to FIG. 7, electrical resistance heating rod 170 may be electrically coupled to power supply 142 through power cord 140. In this manner, a single power cord may be coupled to first mold segment 110 at the bottom of ice press 100. In addition, base heater 146 may not be required at all when using electrical resistance heating rods 170. Therefore, ice press 100 may have a simpler construction, lower-cost components, and improved operability and heating. It should be appreciated that according to alternative embodiments, second mold segment 120 may include any suitable number of structural sleeves 134 for receiving any suitable combination of structural guide rails 132, heat pipes 150, and/or electrical resistance heating rods 170.

Turning now again to FIG. 6, in some embodiments, one or more portions of mold body 106 are tapered (e.g., radially inward). Such tapering may generally extend inward toward the mold cavity 108. As an example, the outer sidewall 112 of first mold segment 110 may be tapered from a lower portion of the first mold segment 110 to an upper portion of the first mold segment 110 (e.g., along the axial direction A from a receiving tray 180 to first mating surface 118). In some such embodiments, at least a portion of outer sidewall 112 thus forms a frusto-conical member having a larger diameter at the lower portion (e.g., distal to mold cavity 108) and a smaller diameter at the upper portion (e.g., proximal to mold cavity 108).

As an additional or alternative example, the outer sidewall 122 of second mold segment 120 may be tapered from an upper portion of the second mold segment 120 to a lower portion of the second mold segment 120 (e.g., along the axial direction A from the handle 136 to second mating surface 128). In some such embodiments, at least a portion of outer sidewall 122 thus forms a frusto-conical member having a larger diameter at the upper portion (e.g., distal to mold cavity 108) and a smaller diameter at the lower portion (e.g., proximal to mold cavity 108).

In some embodiments, both outer sidewalls 112, 122 are formed as mirrored tapered bodies that converge, for instance, radially outward from mold body 106. Notably, extraneous portions of the initial ice billet 102 (FIG. 3) that are not needed for the mass of the sculpted ice nugget 104 (FIG. 4) may be readily separated from billet 102 (e.g., as shaved ice chunks) and directed away from mold cavity 108. Moreover, the tapered form may advantageously concentrate the heat directed towards the ice billet 102 (e.g., radially outward from the cavity portions 116, 126).

In optional embodiments, a receiving tray 180 is provided on first mold segment 110 (e.g., below mold cavity 108). For example, receiving tray 180 may be attached to or formed integrally with first mold segment 110 at a lower portion thereof. As shown, receiving tray 180 extends radially outward from, for instance, outer sidewall 112. Moreover, receiving tray 180 may form a circumferential channel 182 about mold body 106. During use, extraneous portions of the initial ice billet 102 (FIG. 3) may thus accumulate within the circumferential channel 182 of receiving tray 180 (e.g., as water or separated ice chunks), instead of the counter or surface on which ice press 100 is supported.

Remaining at FIG. 6, in certain embodiments, one or more water channels 184, 186 are defined through mold body 106. Such water channels 184, 186 may be in fluid communication with mold cavity 108 and generally permit melted water to flow therefrom (e.g., from an outer sidewall 112, 122 to the ambient environment and, subsequently, receiving tray 180). Moreover, in comparison to the diameter of mold body 106, the diameter of water channels 184, 186 through which water passes may be relatively small (e.g., about $1/16^{th}$ of an inch).

In some embodiments, a first mold segment 110 defines a lower water channel 184 that extends in fluid communication between inner cavity wall 114 and outer sidewall 112. For instance, the lower water channel 184 may extend from the first cavity portion 116 (e.g., at an axially lowermost portion thereof) and to the outer sidewall 112. As ice within the first cavity portion 116 melts to liquid water, at least a portion of that water may thus pass from the first cavity portion 116, through the lower water channel 184, and to the ambient environment (e.g., toward the receiving tray 180). Notably, melted water may be readily exhausted from below mold cavity 108, permitting contact to be maintained between inner cavity wall 114 and the ice thereabove as it is melted.

In additional or alternative embodiments, a second mold segment 120 defines an upper water channel 186 that extends in fluid communication between inner cavity wall 124 and outer sidewall 122. For instance, the upper water channel 186 may extend from the second cavity portion 126 (e.g., at an axially uppermost portion thereof) and to the outer sidewall 122. As ice within the second cavity portion 126 melts to liquid water, at least a portion of that water may thus pass from the second cavity portion 126, through the upper water channel 186, and to the ambient environment (e.g., toward the receiving tray 180). Notably, melted water may be readily exhausted from above mold cavity 108, permitting contact to be maintained between inner cavity wall 124 and the ice therebelow as it is melted.

Generally, operation of the heater(s) 144 may be directed by a controller 190 in operative communication (e.g., wireless or electrical communication) therewith. Controller 190 may include a memory (e.g., non-transitive media) and microprocessor, such as a general or special purpose microprocessor operable to execute programming instructions or micro-control code associated with a selected heating level, operation, or cooking cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

In certain embodiments, one or more temperature sensors 192, 194 (e.g., thermistors, thermocouples, dielectric switches, etc.) are provided on or within mold body 106 (e.g., in thermal communication with mold cavity 108). Moreover, such temperature sensors 192, 194 may be in operative communication (e.g., wired electrical communication) with controller 190. In some embodiments, a base temperature sensor 192 is mounted within first mold segment 110. In additional or alternative embodiments, a top temperature sensor 194 is mounted within second mold segment 120.

In certain embodiments, the controller 190 is configured to activate, deactivate, or adjust the heaters 144 based on temperature detected at the sensor(s) 192, 194. As an example, a predetermined temperature threshold value or range may be provided (e.g., at controller 190) to prevent overheating of the heaters 144. If a detected temperature at sensor 192 or 194 is determined to exceed the threshold value or range, heaters 144 may be deactivated or otherwise restricted in heat output. If a subsequent detected temperature at sensor 192 or 194 is determined to fall below or within the threshold value or range, heaters 144 may be reactivated or otherwise increased in heat output. Optionally, deactivation-reactivation may be repeated continuously (e.g., as a closed feedback loop) during operation of ice press 100. Notably, excessive temperatures at the mold body 106 may be prevented (e.g., when mold body 106 is not in contact with ice or when a reshaping operation for a sculpted nugget 104 is complete). Moreover, although one example of heat control and adjustment using a threshold value or range is explicitly described, it is noted any suitable configuration may further be provided (e.g., within controller 190).

Advantageously, the described embodiments of ice press 100 may rapidly and evenly heat ice billet 102 (FIG. 3) from opposite axial ends as mold body 106 is guided to the sculpted position. Moreover, the press 100 may advantageously be reused multiple times without requiring any interruption to use (e.g., other than removing a sculpted ice nugget 104 from first cavity portion 116 and placing a new ice billet 102 between the mold segments 110, 120). Furthermore, relatively little of material may be required for such rapid and repeated ice shaping. In addition, the heating of the entire mold body 106 may be achieved with a single electrical supply cord.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An electric ice press defining an axial direction, the electric ice press comprising:

a mold body comprising a first mold segment and a second mold segment, the first mold segment and the second mold segment being movable relative to each other along the axial direction and defining a mold cavity;

a heated guide rail extending from the first mold segment toward the second mold segment along the axial direction, wherein the heated guide rail comprises an electrical resistance heating rod electrically coupled to a power cord; and a sleeve defined within the second mold segment for receiving the heated guide rail and for placing the second mold segment in thermal communication with the heated guide rail.

2. The electric ice press of claim 1, wherein the electric ice press comprises a plurality of heated guide rails extending from the first mold segment for receipt in a plurality of sleeves defined in the second mold segment.

3. The electric ice press of claim 1, further comprising:

a structural guide rail extending from the first mold segment toward the second mold segment along the axial direction parallel to the heated guide rail; and a structural sleeve defined within the second mold segment for receiving the structural guide rail for aligning the first mold segment and the second mold segment.

4. The electric ice press of claim 1, wherein the first mold segment and the second mold segment are movable between a receiving position for receiving an initial ice billet and a sculpted position for reshaping the initial ice billet into a sculpted ice nugget within the mold cavity.

5. The electric ice press of claim 1, wherein the first mold segment defines a first cavity portion of the mold cavity and the second mold segment defines a second cavity portion of the mold cavity, wherein the first cavity portion is an upper hemispherical void, and wherein the second cavity portion is a lower hemispherical void.

6. The electric ice press of claim 1, wherein the first mold segment is stationary and the second mold segment is positioned above the first mold segment and is movable relative to the first mold segment.

7. The electric ice press of claim 1, further comprising:

a water channel in fluid communication with the mold cavity for draining water from the mold cavity.

8. An electric ice press defining an axial direction, the electric ice press comprising:

a first mold segment;

a second mold segment movable relative to the first mold segment along the axial direction;

an electrical resistance heating rod extending from the first mold segment toward the second mold segment along the axial direction;

a sleeve defined within the second mold segment for receiving the electrical resistance heating rod and for placing the second mold segment in thermal communication with the electrical resistance heating rod; and a power cord electrically coupled to the electrical resistance heating rod through the first mold segment.

9. The electric ice press of claim 8, wherein the electric ice press comprises a plurality of electrical resistance heating rods extending from the first mold segment for receipt in a plurality of sleeves defined in the second mold segment.

10. The electric ice press of claim 8, further comprising:

a structural guide rail extending from the first mold segment toward the second mold segment along the axial direction parallel to the electrical resistance heating rod; and a structural sleeve defined within the second mold segment for receiving the structural guide rail for aligning the first mold segment and the second mold segment.

11. The electric ice press of claim 8, wherein the first mold segment and the second mold segment are movable between a receiving position for receiving an initial ice billet and a sculpted position for reshaping the initial ice billet into a sculpted ice nugget within the mold cavity.

12. The electric ice press of claim 8, wherein the first mold segment defines a first cavity portion and the second mold segment defines a second cavity portion, wherein the first cavity portion is an upper hemispherical void, and wherein the second cavity portion is a lower hemispherical void.

13. The electric ice press of claim 8, wherein the first mold segment is stationary and the second mold segment is positioned above the first mold segment and is movable relative to the first mold segment.

14. The electric ice press of claim 8, further comprising:

a mold cavity defined by the first mold segment and the second mold segment; and a water channel in fluid communication with the mold cavity for draining water from the mold cavity.

* * * * *